US005362162A

United States Patent [19]

Takahashi

[11] Patent Number: 5,362,162

[45] Date of Patent: Nov. 8, 1994

[54] TAPE CASSETTE WITH IMAGE RECEIVING MEMBER AND PROTECTION SHEET

[75] Inventor: Toshio Takahashi, Nagoya, Japan

[73] Assignee: Brother Kogyo Kabushiki Kaisha, Nagoya, Japan

[21] Appl. No.: 18,531

[22] Filed: Feb. 17, 1993

[30] Foreign Application Priority Data

Feb. 27, 1992 [JP] Japan ..... 4-009219[U]

[51] Int. Cl.[5] ..... B41J 32/00

[52] U.S. Cl. ..... 400/613; 156/289

[58] Field of Search ..... 400/120, 208, 613, 237, 400/241; 156/277, 289, 384, 385, 386, 387, 390, 355, 556, 560

[56] References Cited

U.S. PATENT DOCUMENTS

| | | | |
|---|---|---|---|
| 5,165,806 | 11/1992 | Collins | 400/120 |
| 5,183,333 | 2/1993 | Minowa | 400/120 |
| 5,188,469 | 2/1993 | Nagao et al. | 400/208 |
| 5,203,951 | 4/1993 | Hattori et al. | 156/384 |

FOREIGN PATENT DOCUMENTS

| | | |
|---|---|---|
| 0057940 | 8/1982 | European Pat. Off. . |
| 0410259A1 | 1/1991 | European Pat. Off. . |
| 0457309A2 | 11/1991 | European Pat. Off. . |
| 0467414A2 | 1/1992 | European Pat. Off. . |
| 3-292187 | 12/1991 | Japan . |
| 3-292188 | 12/1991 | Japan . |
| 3-292189 | 12/1991 | Japan . |
| 4-5048 | 1/1992 | Japan . |
| 4-45980 | 2/1992 | Japan . |
| 4-45981 | 2/1992 | Japan . |
| 4-47984 | 2/1992 | Japan . |
| 4-49088 | 2/1992 | Japan . |
| 4-93290 | 3/1992 | Japan . |
| 2005596A | 4/1979 | United Kingdom . |

*Primary Examiner*—David A. Wiecking
*Attorney, Agent, or Firm*—Oliff & Berridge

[57] ABSTRACT

A tape cassette has a printing tape which can be cut completely by a cutting blade and can improve the quality of subsequent printing onto a cloth. The input characters and symbols are printed on a hot-melting type adhesive layer of the printing tape by energizing a thermal head and generating heat from the heat-generating element. The hot-melting type adhesive layer of the printing tape is overlapped with a protection sheet by the driving roller and a tape feeding roller and the printing tape, overlapped with the protection sheet, is fed out of the printing device and cut.

10 Claims, 8 Drawing Sheets

TAPE CASSETTE WITH IMAGE RECEIVING MEMBER AND PROTECTION SHEET

BACKGROUND OF THE INVENTION

1. Field of the Invention

The invention relates to a tape cassette which can be detachably installed in a printing device having a printing head and a platen that opposes the tape cassette and parted therefrom relatively, and more particularly, to the tape cassette whose tape has a desired heat transfer image thereon to be thermally transferred onto an image receiving member such as cloth, paper and so on.

2. Description of Related Art

In a printing device in which this type of tape cassette is loaded, a rotatable character selection dial 4 is provided on top of a main body 2 as shown in FIG. 4. Function keys 10, such as a power supply switch 6 and a print key 8, which are operable for controlling the printing device 1, and a crystal display 12 (LCD), for displaying input characters, symbols and the like, are provided adjacent to the character selection dial 4. A cassette receiving accommodation recess 80 is provided on the back side of the main body 2 as shown in FIG. 5. A tape cassette 70 can be detachably loaded therein.

A printing spool 18 is rotatably disposed in the tape cassette 70 as shown in FIG. 8. A printing tape 20, which is comprised of a substrate sheet **20*b* and a hot-melting type adhesive layer 20*a* (see FIG. 9) and is for being thermally transferred with pressure onto a cloth, is wound on the printing spool 18 with the hot-melting type adhesive layer 20*a*** on the inner side.

The materials, structure and features of the hot-melting type adhesive layer **20*a* and the substrate sheet 20*b*** are same as those disclosed in Japanese Laid Open No. 3-292187.

The hot-melting type adhesive layer **20*a* is transferred onto a cloth with characters and symbols printed on the hot-melting type adhesive layer 20*a* by applying heat and pressure to the printing tape 20 by an iron or similar device. Therefore, the hot-melting type adhesive layer 20*a* must be easily separable from the substrate sheet 20*b* regardless of the hot or cool state of the hot-melting type adhesive layer 20*a* after the layer 20*a* is transferred onto the cloth. That is, the substrate sheet 20*b* must be separable from the hot-melting type adhesive layer 20*a* just after the transfer or adhesion of the hot-melting type adhesive layer 20*a* to the cloth using heat and pressure and even after a long time has passed following the transfer or adhesion. In this respect, the hot-melting type adhesive layer 20*a* is bonded to the substrate sheet 20*b*** by an adhesive with a releasable or separable property.

Because characters, symbols, etc. are printed on the hot-melting type adhesive layer **20*a* by the printing device 1, the hot-melting type adhesive layer 20*a*** must be formed of a material which provides an ink-philic property to ensure a high quality of printing without blur, blotting, distortion and/or other substandard print characteristics.

Furthermore, the hot-melting type adhesive material must be selected in due consideration of factors which may affect the quality of the finally transferred print image after heating and pressing. These factors include brilliance and fastness against washing, light and sweat. According to these factors, thermoplastic resin is used for the hot melt adhesive.

Release processing is provided to the substrate sheet **20*b* to prevent blocking or bonding of the hot-melting type adhesive layer 20*a*** thereto.

An ink ribbon 26 which is obtained by coating a heat melting ink over a base film is wound on a ribbon supplying spool 28 with its ink surface on the inner side and the ink ribbon 26 is wound on a winding up spool 30 after printing.

The printing tape 20 is fed to a roller entrance 34 via the printing tape spool 18 and a guide shaft 32. Then, from a tape feeding roller 36, the printing tape 20 is fed outside the tape cassette 70 through a slit below a tape presser 23.

On the other hand, the ink ribbon 26 is fed from the ribbon supplying spool 28, between the printing tape 20 and the guide shaft 32, and then to the roller entrance 34 in overlapping contact with the printing tape 20. After the ink ribbon 26, overlapped with the printing tape 20, is fed to the roller entrance 34, the ink ribbon 26 changes its rotating direction, by 180 degrees, by means of a releasing plate and is fed to a ribbon winding up spool 30. A releasing plate 40 is fixed in the tape cassette 70 at a position which is away from a heat-generating element 49 of a thermal head 48, by a predetermined distance, downstream of the ink ribbon 26 feeding direction. The releasing plate 40 releases the ink ribbon 26 from the printing tape 20.

A thermal head insertion recess 47, which is surrounded by the ink ribbon 26 and a surrounding wall 46 is provided upstream of the releasing plate 40 in the feeding direction. The thermal head 48, installed in the main body 2, is inserted into the insertion recess 47 when the tape cassette 70 is loaded in the printing device 1. The heat-generating element 49 is arranged in a row at one end of the thermal head 48 so that the heat-generating element is at a right angle to the ink ribbon 26 feeding direction thus the heat-generating element 49 faces the ink feeding ribbon.

As shown in FIG. 5, a tape feeding drive shaft 50 and a ribbon winding up spool shaft 52 are installed in the main body 2. The tape feeding drive shaft 50 is engaged to the tape feeding roller 36 and the ribbon winding up spool shaft 52 is engaged to the ribbon winding up spool 30 when the tape cassette 70 is loaded in the cassette recess 80. The tape feeding drive shaft 50 and the ribbon winding up spool shaft 52 are driven by a pulse motor.

A movable platen roller 58 and a drive roller 60 are rotatably supported on a roller holder 56 which is rotatably supported by a rotation shaft 54 fixed to the main body 2 of the printing device. The movable platen roller 58 and the drive roller 60 are inserted into the roller entrance 34 by the operation of a roller release lever 62 that rotates the roller holder 56 around the rotation shaft 54. When the movable platen roller 58 and the drive roller 60 are inserted into the roller entrance 34, the printing tape 20 and the ink ribbon 26, exposed to the roller entrance 34, are sandwiched between the movable platen roller 58 and the heat-generating elements 49 while being overlapped with one another. Downstream of the ink ribbon 26 feeding direction, the printing tape 20 is fed outside the tape cassette 70 sandwiched between the driving roller 60 and the tape feeding roller 36.

A cutting lever 64 and a rotation cutter 66, which rotates in accordance with a rotation of the cutting lever 64, are provided downstream of the driving roller 60 of the main body 2. A cutting blade receiving unit 81, consisting a flat surface for receiving a cutting blade **66*a*** of the rotation cutter 66 is disposed in the tape cassette 70 as shown in FIG. 9. A groove 81*a*, having a "V" shape is formed in the cutting blade receiving unit 81 by cutting the printing tape 20.

The tape cassette, having the above-mentioned structure, operates as described below.

A tape cassette 70 is loaded into the printing device 1. Desired characters and symbols can then be input, using the character selection dial 4 and the function keys 10, by an operator.

If the print key 8 is pressed by the operator, the thermal head 48 is energized and the heat-generating element 49 generates heat based on data defining the input characters and symbols simultaneously with the feeding, at a predetermined speed, of the overlapped printing tape 20 and the ink ribbon 26. As a result, an ink layer 21, consisting of ink images of the input characters and symbols is formed on the hot-melting type adhesive layer 20*a* of the printing tape 20, and the printing tape 20 is fed to the outside of the printing device 1 by the driving roller 60.

After printing is complete, the cutting lever 64 is rotated by the operator, in the direction of the arrow A shown in FIG. 8, and the rotating cutter 66 rotates in the direction of the arrow B. As a result, the printing tape 20 fed outside the cassette 70 is pressed against the cutting blade receiving unit 81 of the tape cassette 70 by the cutting blade 66*a* of the rotation cutter 66 and the printing tape 20 is cut.

The cut printing tape 20 is then placed on a cloth with the ink layer 21 against the cloth. Heat and pressure are applied from the substrate sheet 20*b* side by an iron or the like and the hot-melting type adhesive layer 20*a* is transferred onto the cloth with the ink layer 21 of the characters and symbols previously formed on the printing tape 20. Thus, images of the characters and symbols are formed on the cloth with the hot-melting type adhesive layer 20*a* by releasing the substrate sheet 20*b* from the hot-melting type adhesive layer 20*a* after the hot-melting type adhesive layer 20*a* is transferred to the cloth by the iron.

In the above-mentioned tape cassette, there is a problem. As mentioned above, the hot-melting type adhesive layer 20*a* of the printing tape 20 and the substrate sheet 20*b* are bonded together by a releasable or separable adhesive and the release processing is provided to the substrate sheet 20*b*. However, to cut the printing tape 20, it is pressed into the groove 81*a* formed in the cutting blade receiving unit 81 of the tape cassette 70, by the cutting blade 66*a* of the rotation cutter 66 as shown in FIG. 9.

Therefore, the pressure of the cutting blade 66*a* causes the hot-melting type adhesive layer 20*a*, on which the characters and symbols are printed, to be separated from the substrate sheet 20*b* and enter the groove 81*a*. As a result, the hot-melting type adhesive layer 20*a* might not be completely cut. Therefore, the printing tape 20 has not been completely cut.

Further, the images of the characters and symbols printed on the printing tape 20 are exposed until they are transferred onto a cloth by applying heat and pressure. Therefore, if the operator touches the images printed on the printing tape 20 before the printing tape 20 is pressed and heated onto the cloth by an iron, the ink on the printing tape 20 might be released from the printing tape 20 and a complete transfer of the images to the cloth cannot be obtained.

SUMMARY OF THE INVENTION

The invention is made to solve the above-mentioned problems. The object of the invention is to provide a tape cassette whose tape can be cut completely by a cutting blade and one which improves a quality of printing onto a cloth.

In order to achieve the object, a tape cassette which is loaded detachably in a printing device having a printing head and a platen which are relatively spaced apart and in contact with each other, comprises:

an ink ribbon which is positioned between the printing head and the platen when the tape cassette is received in the printing device;

an image receiving member having a substrate and a hot-melting type adhesive layer on which an image is formed by the printing head, the hot-melting type adhesive layer which is transferred onto a receiving material with the image by applying heat and pressure, the image receiving member being positioned between the printing head and the platen overlapped with the ink ribbon when the tape cassette is received in the printing device; and a protection sheet with which the hot-melting type adhesive layer is covered after an image is formed on the hot-melting type adhesive layer by the printing head.

In a tape cassette having the above-mentioned structure, when the tape cassette is loaded into a printing device, the ink ribbon is positioned between the printing head and the platen and the image receiving member, having the hot-melting type adhesive layer on which an image is formed by the printing head, is positioned between the printing head and the platen so that the hot-melting type adhesive layer is overlapped with the ink ribbon. Further, the hot-melting type adhesive layer is transferred onto a receiving medium with the image thereon by applying a heat and pressure.

Due to the arrangement of the protection sheet overlapped with the hot-melting type adhesive layer of the image receiving medium, the image receiving medium can be cut completely and the quality of printing onto a cloth can be improved.

As is clear from the above-mentioned explanation, in a tape cassette of the invention, the protection sheet is overlapped with the hot-melting type adhesive layer after images of desired characters or symbols are formed on the hot-melting type adhesive layer of the image receiving member and the image receiving member which is overlapped with the protection sheet is fed to the outside of the printing device and cut. Therefore, the tape can be cut completely and a printed surface of the tape never touches anything before being transferred onto a cloth by applying heat and pressure. Therefore, the quality of printing onto a cloth can be improved.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

Figure 1:
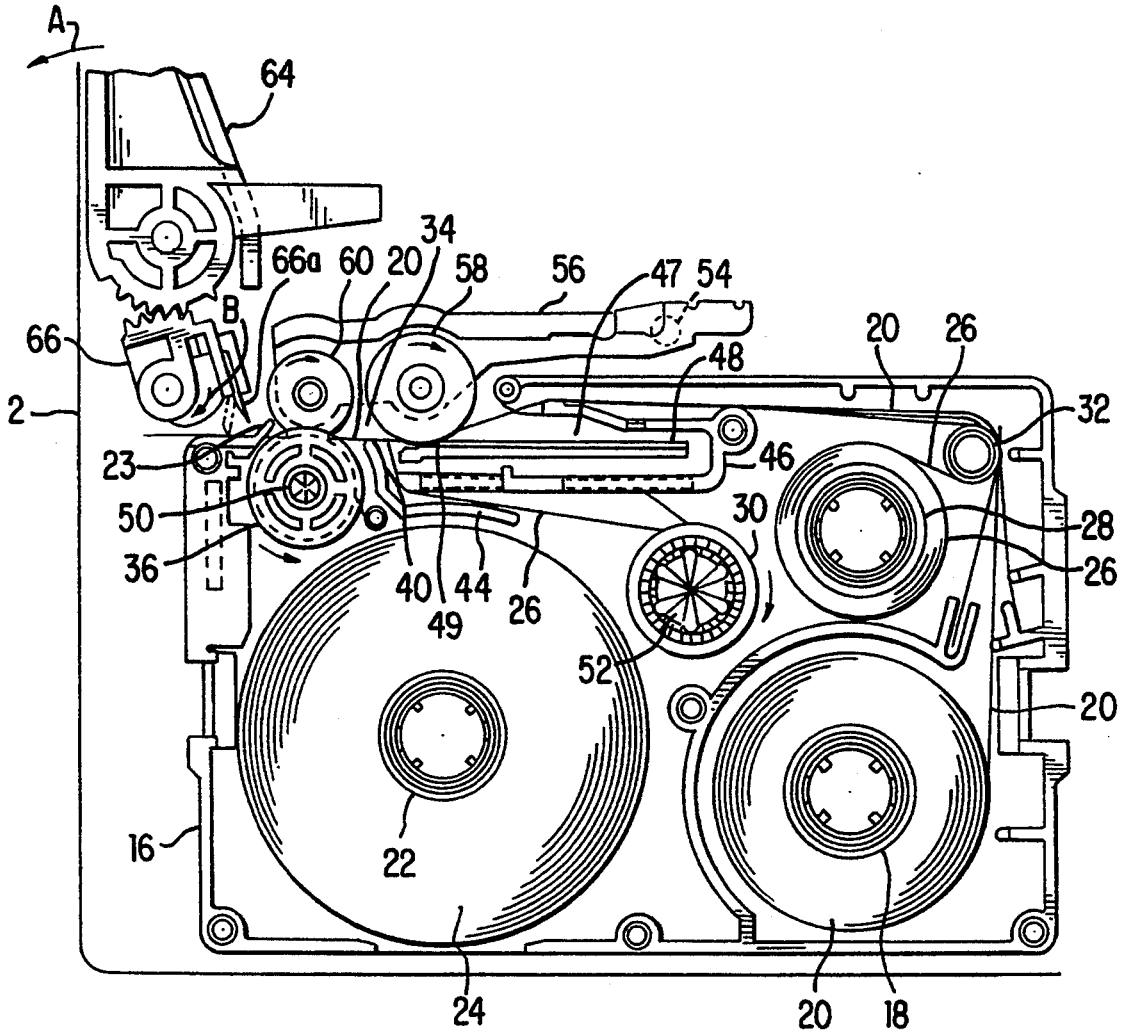
FIG. 1 is a plan view of the inside of a tape cassette of a preferred embodiment of the invention.

A preferred embodiment of the invention is explained by referring to the drawings. To avoid redundancy, for those parts that are the same as those of the related art, the same reference numbers are used and the explanation thereof is omitted.

First, the structure of a tape cassette 16 of the embodiment is explained.

The printing tape 20 and the ink ribbon 26 are arranged in the tape cassette 16 as shown in FIG. 1. A protection sheet spool 22 is rotatably provided in the tape cassette 16 and a protection sheet 24 is wound on the protection sheet spool 22. The protection sheet 24 is fed from the protection sheet spool 22 to the tape feeding roller 36 and overlapped with the printing tape 20 prior to feeding to the outside of the printing device 1.

A separation wall member 44 is provided between the ink ribbon 26 and the protection sheet 24 adjacent to the roller entrance 34. The separation wall member 44 prevents the ink ribbon 26 from touching the protection sheet 24 and dirtying the protection sheet 24.

The protection sheet 24 must be made of a material which has sufficient strength and tension to support the printing tape 20 and the hot-melting type adhesive layer 20*a* when cut by the cutting blade 66*a*, such as a plain paper or a film.

Figure 2:
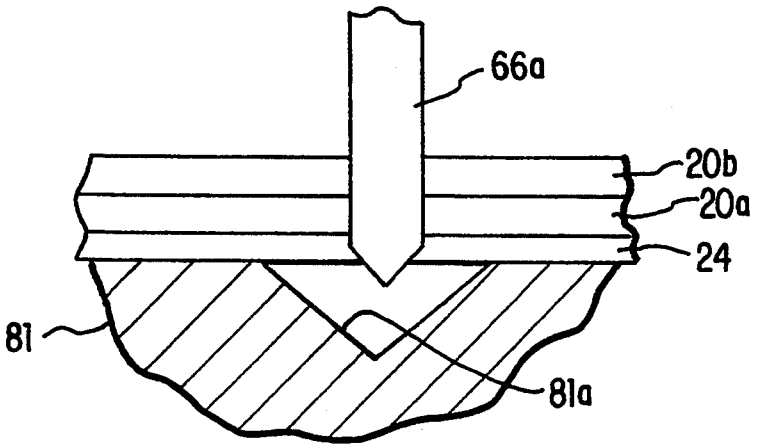
FIG. 2 is a side view of the tape being cut.

If a film is used for the protection sheet 24 it should have the following characteristics. First, the film should not have an extreme extension. If a film having an extreme extension is used for the protection sheet 24, the film stretches and it enters the cutting groove 81*a* (FIG. 2). As a result, the film cannot support the printing tape 20 and the printing tape 20 cannot be cut completely.

The second characteristic of the film is that it should not adhere to either the hot-melting type adhesive layer 20*a* or the ink layer 25. If the film adheres to the ink layer 25, the ink layer 25 will be peeled from the hot-melting type adhesive layer 20*a* by the film when the film is separated from the hot-melting type adhesive layer 20*a*. On the other hand, if the film adheres to the hot-melting type adhesive layer 20*a*, the hot-melting type adhesive layer 20*a* will be peeled from the substrate 20*b*. Therefore, to use some films it may be necessary to provide a release processing characteristic. Further, the material of the protection sheet 24 must be easily cut by the cutting blade 66*a*. For example, a thickness of the protection sheet 24, whether a paper sheet or a film, is 80±10 microns. The protection sheet 24 may be formed of a wood free paper. No matter what the composition of the protection sheet 24 is, it should have substantially the same strength.

Next, an operation of the tape cassette having the above-mentioned structure is explained.

After the tape cassette 16 is loaded in the printing device 1, if the selection dial 4 and the function keys 10 are operated by the operator, desired characters and symbols are input. If the print key 8 is pressed by the operator, the printing tape 20 and the ink ribbon 26 are fed at a predetermined speed and the thermal head 48 is energized by the printing device 1 so that the heat-generating element 49 generates heat according to data of the input characters and symbols. Thus, an ink layer 25, consisting of images of the input characters and symbols, is printed on the hot-melting type adhesive layer 20*a* of the printing tape 20.

Afterwards, the hot-melting type adhesive layer 20*a* of the printing tape 20, having the characters and symbols printed thereon, is overlapped with the protection sheet 24 by the driving roller 60 and the tape feeding roller 36 and the printing tape 20, overlapped with the protection sheet 24, is fed out of the printing device 1.

Figure 6:
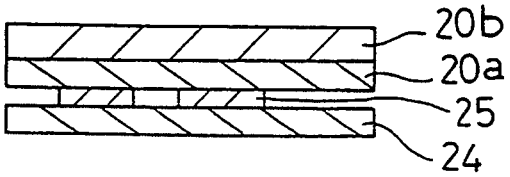
FIG. 6 is a sectional view of a printing tape covered with a protection sheet after being cut.

The cutting lever 64 is operated in the direction of the arrow A (shown in FIG. 1) by the operator and the rotation cutter 66 is rotated in the direction of the arrow B. Then, the overlapped printing tape 20 with the protection sheet 24, which have been fed out of the tape cassette 16, are pressed against the cutting blade receiving unit 81 of the tape cassette 16 by the cutting blade 66*a* of the rotation cutter 66, and the printing tape 20, overlapped with the protection sheet 24, is cut off. The printing tape 20 and the protection sheet 24 which are cut off, ensure the ink layer 25 that is formed on the hot-melting type adhesive layer 20*a* of the printing tape 20 is covered with the protection sheet 24 as shown in FIG. 6.

The protection sheet 24 may be easily separated from the hot-melting type adhesive layer 20*a* because the protection sheet 24 is just overlapped with the hot-melting type adhesive layer 20*a* and not adhered thereto.

Figure 7:
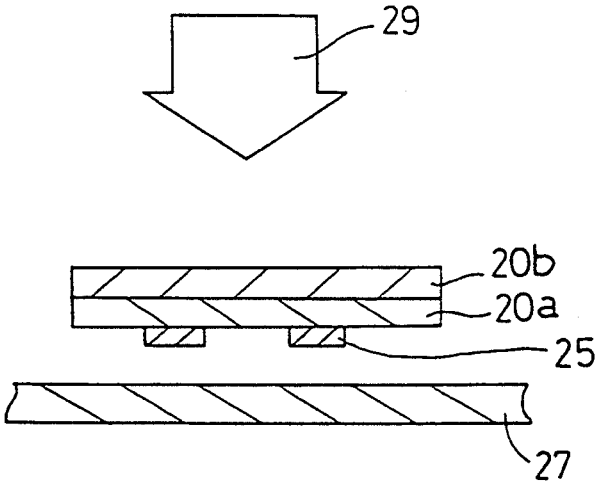
FIG. 7 is a sectional view of a printing tape after being cut and when heat and pressure are applied thereto for application to a cloth.
Figure 8:
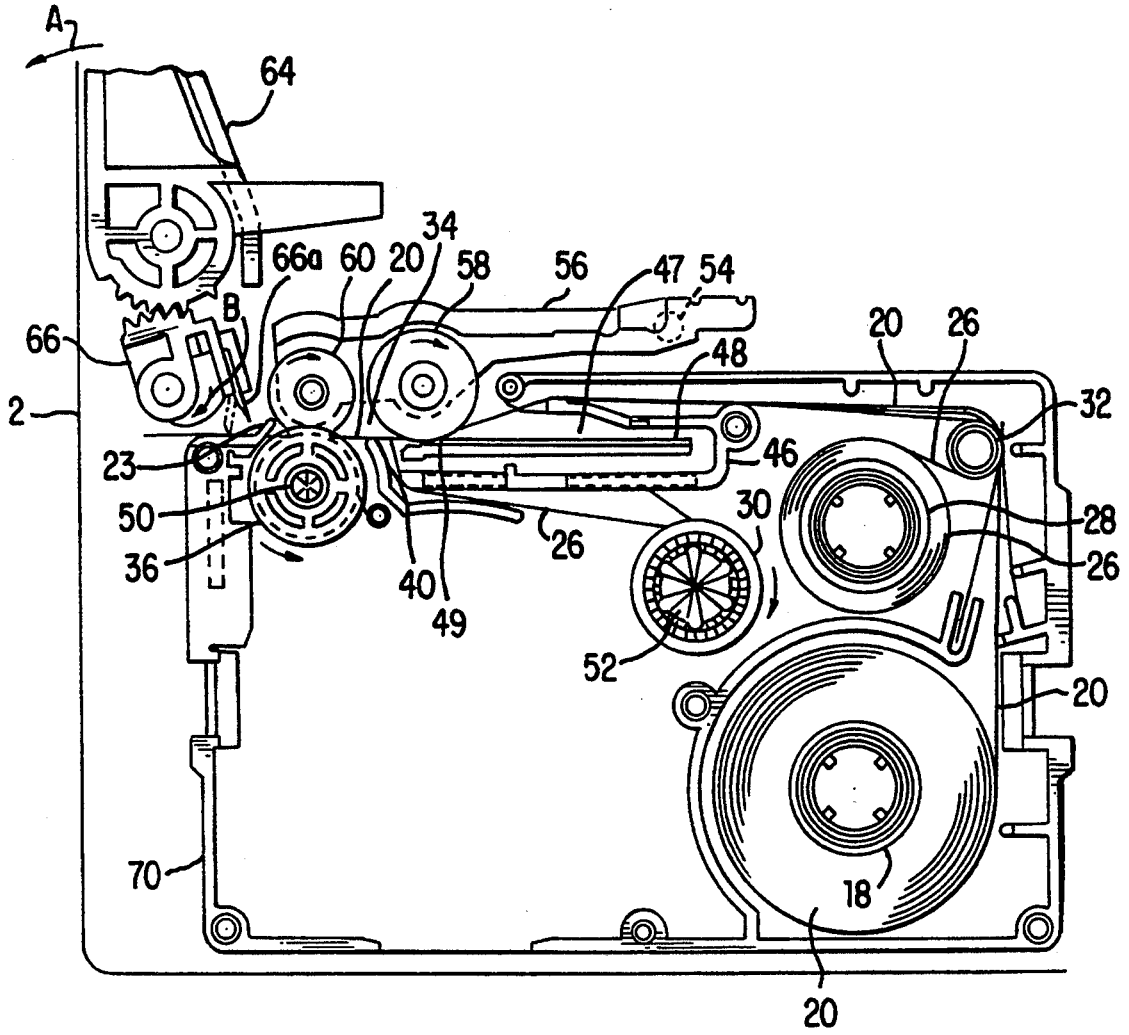
FIG. 8 RELATED ART
FIG. 8 is a plan view of the inside of a tape cassette of the related art.
Figure 9:
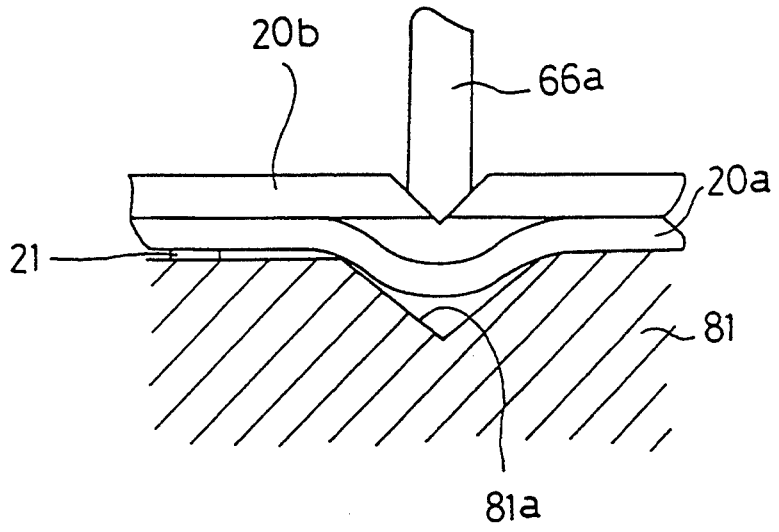
Fig.9 RELATED ART
FIG. 9 is a side view of the tape of the related art being cut.

After the protection sheet 24 is separated from the cut printing tape 20, the printing tape 20 is heated and pressed 29 from its substrate sheet 20*b* side by an iron or similar device as shown in FIG. 7. As a result, the hot-melting type adhesive layer 20*a* is transferred onto a cloth 27 with the ink layer 25 consisting of the characters and symbols. The images of the characters and symbols are formed on the cloth 27 with the hot-melting type adhesive layer 20*a* and the substrate sheet 20*b* is separated from the hot-melting type adhesive layer 20*a*.

In the tape cassette 16 having the above-mentioned structure, the protection sheet 24 is overlapped with the hot-melting type adhesive layer 20*a* which is the printing side of the printing tape 20 after characters and symbols are printed thereon by the thermal head 48. Therefore, the printing side of the tape is not exposed and touches nothing before the tape is heated and pressed by an iron, that is when the printing tape 20, overlapped with the protection sheet 24, is being fed to the outside of the printing device 1 by the driving roller 60 and the tape feeding roller 36 or after the tape is cut the hot-melting type adhesive layer 20*a* is protected. As a result, the quality of printing onto the cloth is improved.

The protection sheet 24 is received in the cutting blade receiving unit 81, with the hot-melting type adhesive layer 20*a* of the printing tape 20 overlapped with the protection sheet 24, and the tape is cut. Therefore, the tape is supported by the protection sheet 24 and the tape is strengthened.

As a result, as shown in FIG. 2, due to the tension of the protection sheet 24, the hot-melting type adhesive layer 20*a* is supported so that it does not enter the groove 81*a* which is formed on the cutting blade receiving unit 81 by cutting the protection sheet 24 and the printing tape 20. Thus, the protection sheet 24 and the printing tape 20 are completely cut.

Figure 3:
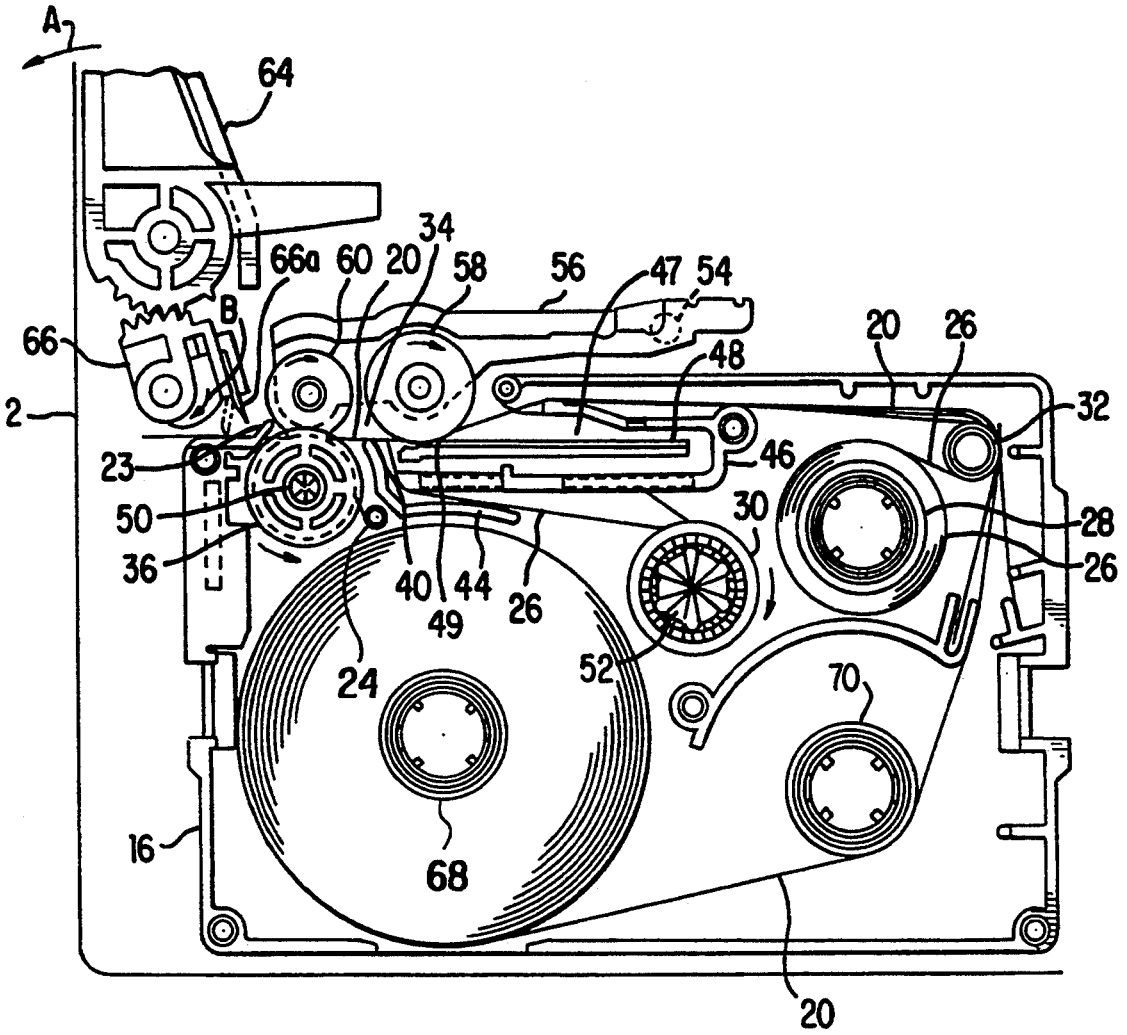
FIG. 3 is a plan view of the inside of a tape cassette of a modified example of the invention.
Figure 4:
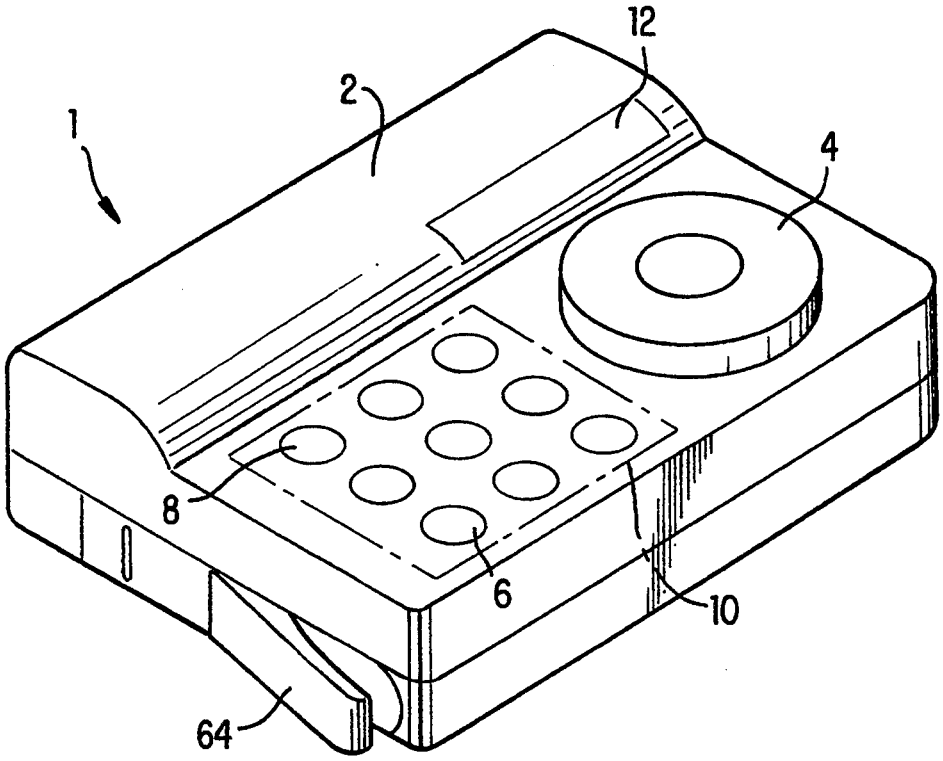
FIG. 4 is a perspective view of a printing device.
Figure 5:
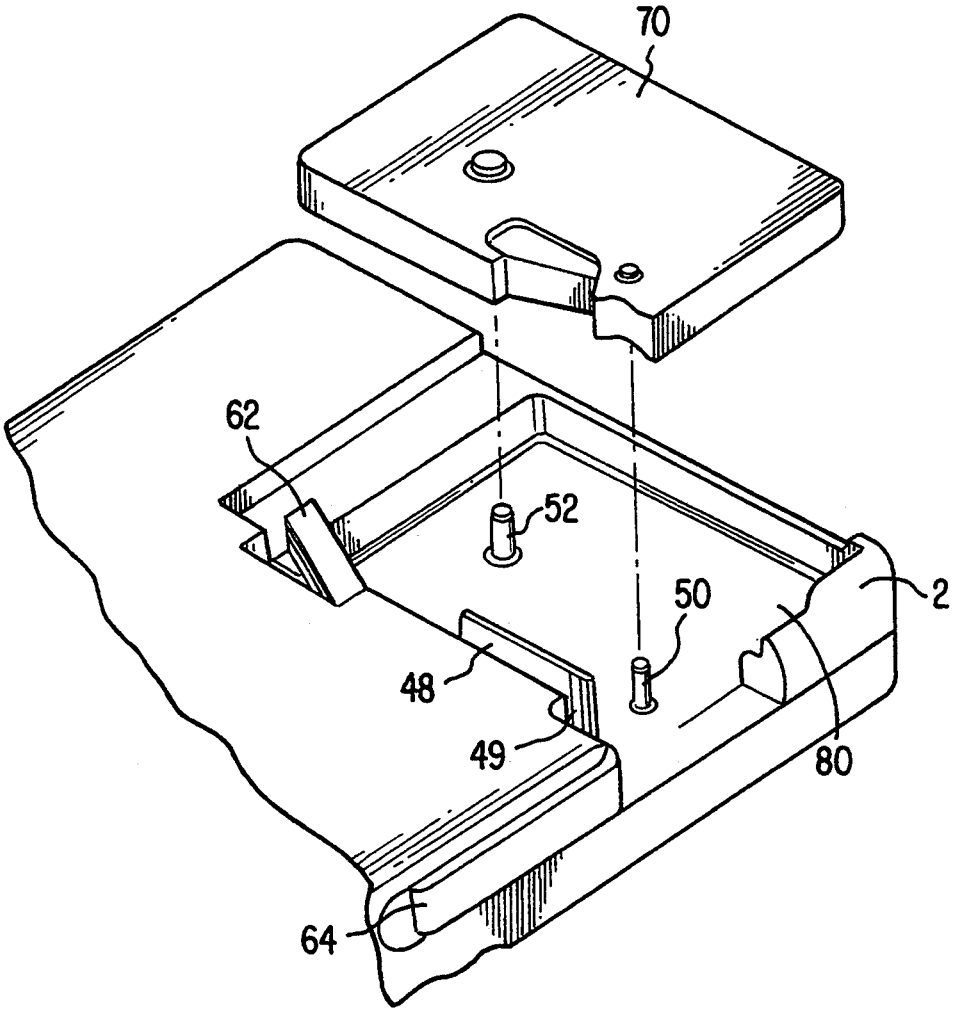
FIG. 5 is a perspective view of a tape cassette installation unit.

In this embodiment, although the protection sheet 24 and the printing tape 20 are wound on different spools, the protection sheet 24 and the printing tape 20 can be wound on the same spool. For example, the overlapped protection sheet 24 and the printing tape 20 can be wound with the protection sheet 24 surface inside the printing tape 20 on a spool 68 as shown in FIG. 3. Since a plurality of spools are not necessary in the tape cassette 16, the tape cassette 16 can be small.

In operation, when the print key is pressed by an operator, the spool 68 is rotated and the printing tape 20 is fed to the roller entrance 34 via a guide spool 70 and the guide shaft 32. The protection sheet 24 on the spool 68 is fed to the driving roller 60 and the tape feeding roller 36. Then, the protection sheet 24 is overlapped with the printing tape 24 by the driving roller 60 and the tape feeding roller 36.

In this embodiment, although the protection sheet 24 and the hot-melting type adhesive layer 20*a* are not bonded but just overlapped together, the protection sheet 24 and the hot-melting type adhesive layer 20*a* can be separably bonded. The bonding strength between the protection sheet 24 and the hot-melting type adhesive layer 20*a* must be weaker than that between the hot-melting type adhesive layer 20*a*, having ink images thereon, and the substrate so that only the protection sheet 24 is easily separated from the hot-melting adhesive layer 20*a* prior to the application of heat and pressure during transfer of the hot-melting type adhesive layer 20*a* to the cloth 27.

What is claimed is:

1. A tape cassette detachably received in a printing device, comprising:

an ink ribbon;

an image receiving member having a substrate and coated thereon a hot-melting type adhesive layer on which an image is formed by transferring ink from the ink ribbon by the printing device; and a protection sheet having only one layer with which the hot-melting type adhesive layer having the image thereon is covered, wherein the protection sheet separably adheres directly to the hot-melting type adhesive layer so that an adhesive strength between the substrate and the hot-melting type adhesive layer is stronger than an adhesive strength between the hot-melting type adhesive layer and the protection sheet.

2. A tape cassette according to claim 1, wherein the protection sheet is overlapped with the hot-melting type adhesive layer after an image is formed on the hot-melting type adhesive layer by the printing device.

3. A tape cassette according to claim 2, wherein the protection sheet is paper.

4. A tape cassette according to claim 2, wherein the protection sheet is a film.

5. A tape cassette detachably received in a printing device having a printing head and a platen, comprising:

an ink ribbon which is positioned between the printing head and the platen when the tape cassette is received in the printing device;

an image receiving member having a substrate and a hot-melting type adhesive layer on which an image is formed by the printing head, the image receiving member being positioned between the printing head and the platen and overlapped with the ink ribbon when the tape cassette is received in the printing device; and a protection sheet having only one layer with which the hot-melting type adhesive layer having the image thereon is covered after an image is formed on the hot-melting type adhesive layer by the printing head, wherein the protection sheet separably adheres directly to the hot-melting type adhesive layer so that an adhesive strength between the substrate and the hot-melting type adhesive layer is stronger than an adhesive strength between the hot-melting type adhesive layer and the protection sheet.

6. A tape cassette according to claim 5, wherein the protection sheet is paper.

7. A tape cassette according to claim 5, wherein the protection sheet is a film.

8. A tape cassette according to claim 5, wherein the protection sheet is overlapped with the hot-melting type adhesive layer after an image is formed on the hot-melting type adhesive layer.

9. A tape cassette to be detachably received in a printing device having a printing head to print on an image receiving member and a platen, comprising:

an ink ribbon which is positioned between the printing head and the platen when the tape cassette is received in the printing device;

an image receiving member having a substrate and a hot-melting type adhesive layer on the substrate on which an image is formed by the printing head, the image receiving member being positioned between the printing head and the platen overlapped with the ink ribbon when the tape cassette is received in the printing device;

a protection sheet having only one layer with which the hot-melting type adhesive layer having the image thereon is covered after an image is printed on the hot-melting type adhesive layer by the printing head; and a cutting position where the image receiving member covered with the protection sheet is cut, wherein the protection sheet is pressed to separably adhere directly to the hot-melting type adhesive layer of the image receiving member so that an adhesive strength between the substrate and the hot-melting type adhesive layer is stronger than an adhesive strength between the hot-melting type adhesive layer and the protection sheet.

10. A tape cassette according to claim 9, wherein the protection sheet is overlapped with the hot-melting type adhesive layer of the image receiving member and the image receiving member overlapped with the protection sheet when fed to the cutting position.

* * * * *